US006931779B1

(12) United States Patent
Galuppo, Jr.

(10) Patent No.: US 6,931,779 B1
(45) Date of Patent: Aug. 23, 2005

(54) MOUNTING DEVICE FOR ATTACHING AN AUXILIARY SIGHT TO A FIREARM

(76) Inventor: Daniel Galuppo, Jr., 1709 Chapin Rd., Georgetown, NY (US) 13072

( * ) Notice: Subject to any disclaimer, the term of this patent is extended or adjusted under 35 U.S.C. 154(b) by 0 days.

(21) Appl. No.: 10/453,984

(22) Filed: Jun. 5, 2003

(51) Int. Cl.[7] ..... F41G 1/387
(52) U.S. Cl. ..... 42/127; 42/114; 42/146; 42/148
(58) Field of Search ..... 42/114, 117, 124, 42/127, 128, 140, 146, 148

(56) References Cited

U.S. PATENT DOCUMENTS

| | | | | | |
|---|---|---|---|---|---|
| 1,856,549 | A | * | 5/1932 | Griffin et al. | 42/127 |
| 2,526,126 | A | * | 10/1950 | Gagnier | 42/127 |
| 3,750,318 | A | * | 8/1973 | Burris | 42/127 |
| 4,341,022 | A | * | 7/1982 | Santoro | 42/127 |
| 4,383,371 | A | * | 5/1983 | Coffey | 42/124 |
| 4,509,282 | A | * | 4/1985 | McMillon | 42/124 |
| 4,799,325 | A | | 1/1989 | Booze | 42/137 |
| 4,905,396 | A | | 3/1990 | Bechtel | |
| 5,033,219 | A | * | 7/1991 | Johnson et al. | 42/115 |
| 5,680,725 | A | * | 10/1997 | Bell | 42/127 |
| 5,787,630 | A | * | 8/1998 | Martel | 42/125 |
| 5,926,964 | A | * | 7/1999 | Korapaty | 42/124 |
| 6,295,754 | B1 | * | 10/2001 | Otteman et al. | 42/124 |
| 6,336,285 | B1 | * | 1/2002 | Baumer | 42/124 |
| 6,449,893 | B2 | | 9/2002 | Spinner | 42/127 |
| 6,453,594 | B1 | | 9/2002 | Griffin | 42/105 |

FOREIGN PATENT DOCUMENTS

DE 32 41 753 A1 * 5/1984

* cited by examiner

*Primary Examiner*—Stephen M. Johnson
(74) *Attorney, Agent, or Firm*—Mark Levy & Associates

(57) ABSTRACT

A scope mount device for a firearm is featured. The scope is attached to an elongated base member that fits within the reveal of the rear sight for large caliber guns. The scope mounting device design is simple and rugged, thus providing reliability and mounting accuracy. The clamping design provides a very low profile.

8 Claims, 5 Drawing Sheets

MOUNTING DEVICE FOR ATTACHING AN AUXILIARY SIGHT TO A FIREARM

FIELD OF THE INVENTION

The invention relates to firearm sighting devices and, more particularly, to a mounting apparatus for a firearm that can mount a scope or night vision aid, and provide a low profile with respect to the frame.

BACKGROUND OF THE INVENTION

In the past, firearm scopes traditionally have been mounted to the firearm frame using devices requiring the machining skills of a professional gunsmith. These mounts are expensive to install because of the labor costs involved.

More recently, a mounting apparatus has been designed that allows the individual to mount a scope or night vision device without the need of professional assistance. One such "no gunsmith" mounting device is illustrated in U.S. Pat. No. 6,449,893 B2, issued to Gerd Spinner on Sep. 17, 2002 for MOUNTING APPARATUS. This mount provides a rail that attaches to the rear of the frame. A mounting base is attached to and slides upon the rail in a longitudinal direction. The base is further composed of two parts that slide relative to each other in a transverse direction. A scope mounted to this base is, therefore, adjustable with respect to the X-Y axes.

Generally speaking, this type of mounting device has a relatively high profile, owing to the multiple layers of sliding components that produce height.

The present invention provides a simpler design that inherently provides a lower profile.

In architectural usage, the side perpendicular to an opening of a window or doorway that fills the space between the window frame and the outer surface of the wall in which the window is inserted, is often referred to as a "reveal". In the case of a firearm, the space through which the sight of the firearm and the target are observed can be referred to as a reveal, defining a rectangular opening through which the sights and the target may be observed. In the particular case where a rear sight of a firearm has been removed from the supporting frame, the space previously occupied by the rear sight is referred to as the reveal of the rear sight. The front and the rear faces of the rectangular space previously occupied by the rear sight are then defined as the front face of the reveal and the rear face of the reveal.

The current invention comprises an elongated base that is disposed within the reveal of the rear sight. The rear sight is removed from the frame of a firearm, and the elongated base is secured in its place. For .22 caliber firearms, the rear sight does not have to be removed. Located about the base are oppositely supported, pivotal clamping arms. The clamping arms pivot toward each other about the base, and secure themselves about the frame of the firearm.

In one embodiment of this invention, a cam mechanism forces the clamping arms toward the frame, thus firmly securing a scope mounted to the base. Centering the scope along the axis of the firearm barrel is easily accomplished with this arrangement, and a low profile is accomplished by supporting the fixture in the reveal of the rear sight. Also, this clamping design allows for a very low profile.

In a second embodiment, the clamps are caused to pivot into engagement with the frame by adjusting four jackscrews.

The mounting device is mounted against the front face of the rear sight reveal, and is thus rigidly secured against the forces of recoil, which tend to misalign the scope. Vertical adjustment screws are not required. In large caliber firearms, anti-recoil screws are required.

DISCUSSION OF RELATED ART

In U.S. Pat. No. 6,453,594, issued to Todd Griffin on Sep. 24, 2002 for APPARATUS FOR ATTACHING A SUPPLEMENTAL DEVICE TO A MINIMALLY ALTERED HOST FIREARM, a mounting fixture that attaches to the barrel of a firearm is shown. The fixture allows for the attachment of a grenade launcher.

In U.S. Pat. No. 4,905,396, issued to Daniel L. Bechtel on Mar. 6, 1990 for METHOD AND APPARATUS FOR MOUNTING AN AUXILIARY SIGHTING AID ON A FIREARM, the fixture has a dovetail shape that receives scope rings of the Weaver type.

In U.S. Pat. No. 4,799,325, issued to Raymond F. Booze on Jan. 24, 1989 for AUXILIARY RIFLE SIGHT, the auxiliary rifle sight attaches to the telescope mounting elements.

SUMMARY OF THE INVENTION

In accordance with the present invention, there is featured a mounting device for securing a scope or a night vision aid to a firearm. The mounting apparatus comprises a base that supports two oppositely disposed clamping jaws that fix the base to the frame of the firearm. The clamping jaws are pivotal about respective elongated pins that pass through each clamping jaw. The base is mounted within the reveal of the rear sight. The mounting device is mounted against the front face of the rear sight reveal, and is thus rigidly secured against the forces of recoil that tend to misalign the scope. Twenty-two caliber firearms do not require removal of the rear sight, as the mount attaches to the frame in front of it.

In one embodiment of this invention, a cam mechanism forces the clamping arms toward the frame of the gun, thus firmly securing a scope mounted to the base. Centering the scope along the axis of the firearm barrel is easily accomplished with this arrangement, and a low profile is accomplished by supporting the fixture in the reveal of the rear sight and unique clamping design. In a second embodiment, the clamps are caused to pivot into fixed engagement with the frame by adjusting four jackscrews.

BRIEF DESCRIPTION OF THE DRAWINGS

A complete understanding of the present invention may be obtained by reference to the accompanying drawings, when considered in conjunction with the subsequent detailed description, in which.

For purposes of brevity and clarity, like components and elements of the apparatus of this invention will bear the same designations or numbering throughout the figures.

DESCRIPTION OF THE PREFERRED EMBODIMENT

Generally speaking, a scope mount device for a firearm is featured. The scope is attached to an elongated base member that fits within the reveal of the rear sight. The scope mounting device's design is simple and rugged, thus providing reliability and mounting accuracy. Twenty-two caliber firearms do not require removal of the rear sight.

Figure 1:
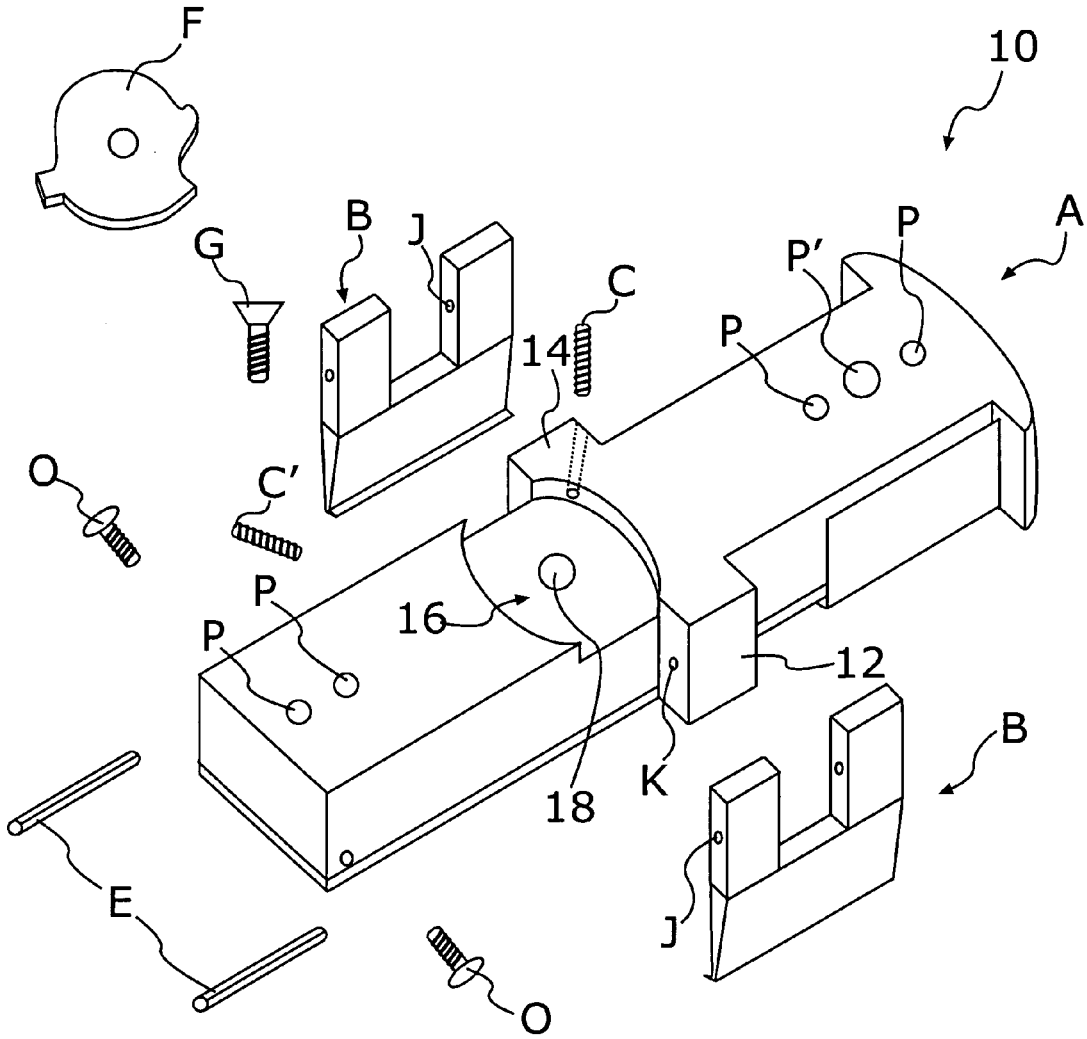
FIG. 1 illustrates an exploded perspective view of a first embodiment of the mounting apparatus of this invention.

Referring to FIG. 1, a perspective, exploded view of the mounting device 10 of this invention is illustrated. The device 10 consists of a longitudinal body A, which defines a base member that supports other components of the mounting device 10, and a scope 26 or night vision aid 20, shown in FIGS. 4 and 3, respectively. The scope 26 or night vision aid 20 are shown diagrammatically, without details, in-as-much as these devices do not form part of the present invention. The scope 26 or night vision aid 20 is mounted on top of the base member A through mounting holes P. The larger mounting hole P' is counterbored, so that the original rear sight elevation screw, not shown, can be reused.

The base member A comprises at least two clamps B, which are disposed in juxtaposition with respect to each other. Each clamp B pivots upon a bearing surface, such as provided by respective pins E that pass through an aperture J running longitudinally through each clamp B. The base member A has two flange abutments 12 and 14, respectively, disposed at its mid-section. The clamps B are pivotally mounted to the base about the flange abutments 12 and 14, respectively, by virtue of pins E that respectively pass through the aperture K, disposed therein. The clamps B pivot with respect to the base member A about the pins E, and fixedly engage the frame of the firearm (not shown here). The clamps B are caused to pivot by means of a cam F, which fits upon the base member A within a recess 16.

A fastener G locates the cam F with the center of the recess 16 about a centering hole 18. At least one cam adjustment screw C is provided to rotate the cam F into the desired clamping position. One cam adjustment screw C' is also needed to unclamp and provide a lock for the cam F.

Two alignment screws O, disposed on opposite sides of the base member A, are used to center the base and attached scope within the frame (not shown). The rear sight is removed from the firearm (large caliber only) to allow the device to mount with a lower profile (closer to the vertical centerline of the barrel), and to abut the front end of the reveal of the rear sight 30 (shown in FIG. 5) in order to resist misalignment caused by recoil forces. The device is placed into the rear sight reveal 30 of the firearm frame 22 near the horizontal centerline of the firearm frame 22 (shown in FIG. 5) after removal of the rear sight from a large caliber firearm.

Turning the cam F, via the adjusting screw C, in a clockwise direction causes the cam F to rotate against the edge of each of the clamps B, thus causing the clamps B to pivot about the base member A and into fixed engagement with the frame of the firearm (not shown). The two alignment screws O are turned clockwise until they gently touch the gun frame (not shown). They provide an easy reference for repeatedly remounting the sight once removed. Turning the cam adjusting screws C and C' in either a clockwise or counterclockwise direction will adjust the cam element F to tighten or release the clamps B from the firearm frame.

Figure 2:
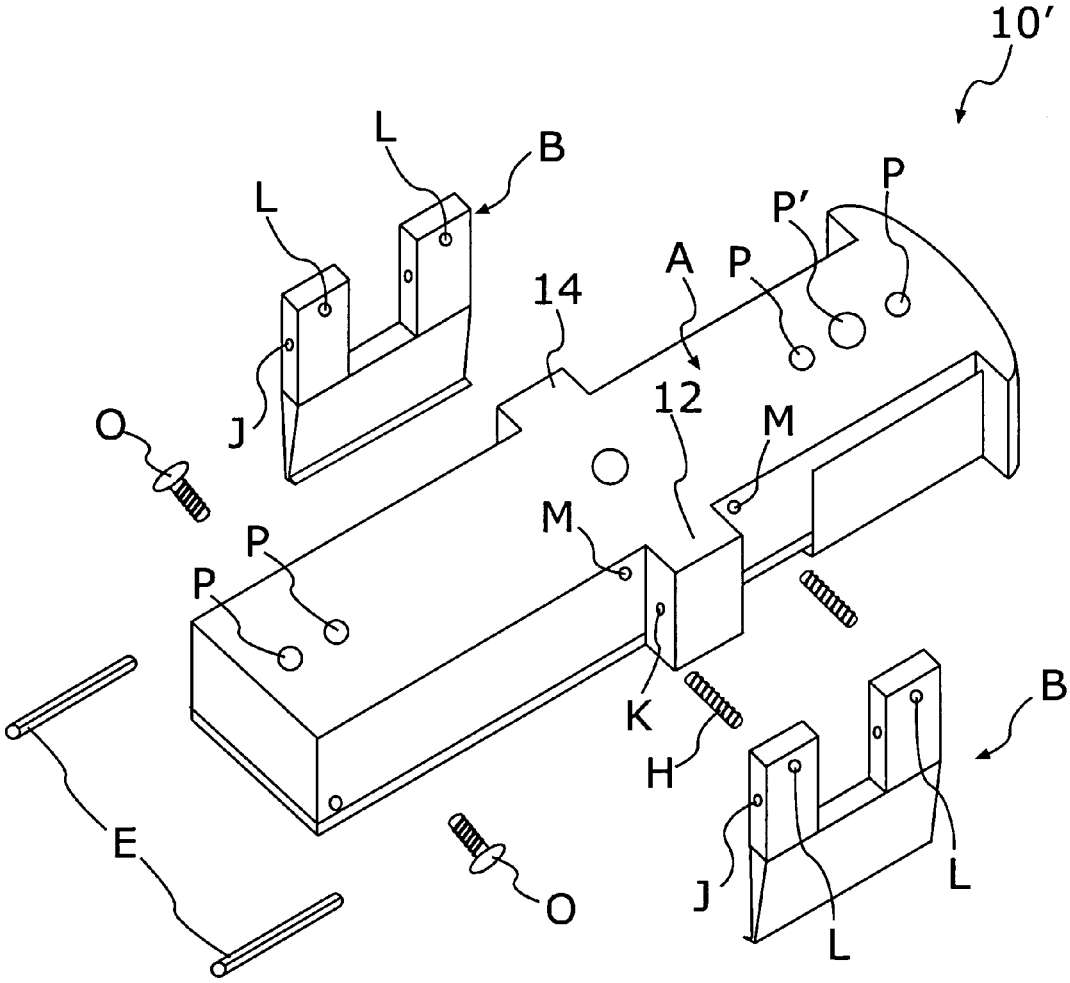
FIG. 2 depicts an exploded perspective view of a second embodiment of the mounting apparatus shown in FIG. 1.

Referring to FIG. 2, a second embodiment 10' of the invention is shown. The clamps B of this embodiment are caused to pivot about the base member A by virtue of four jackscrews H that push against and pass through the clamps B about respective apertures L, for an Allen wrench to pass through, and into the base member A through holes M. The device attaches to the frame of the firearm by turning the jackscrews H, causing the clamps B to fixedly engage the firearm frame (not shown). Turning the jackscrews H counterclockwise within the body forces them against one edge of the clamps B, thus causing the clamps B to pivot on the pins E. This pivoting motion causes the opposite edge of the clamps B to securely clamp each side of the firearm frame.

Figure 3:
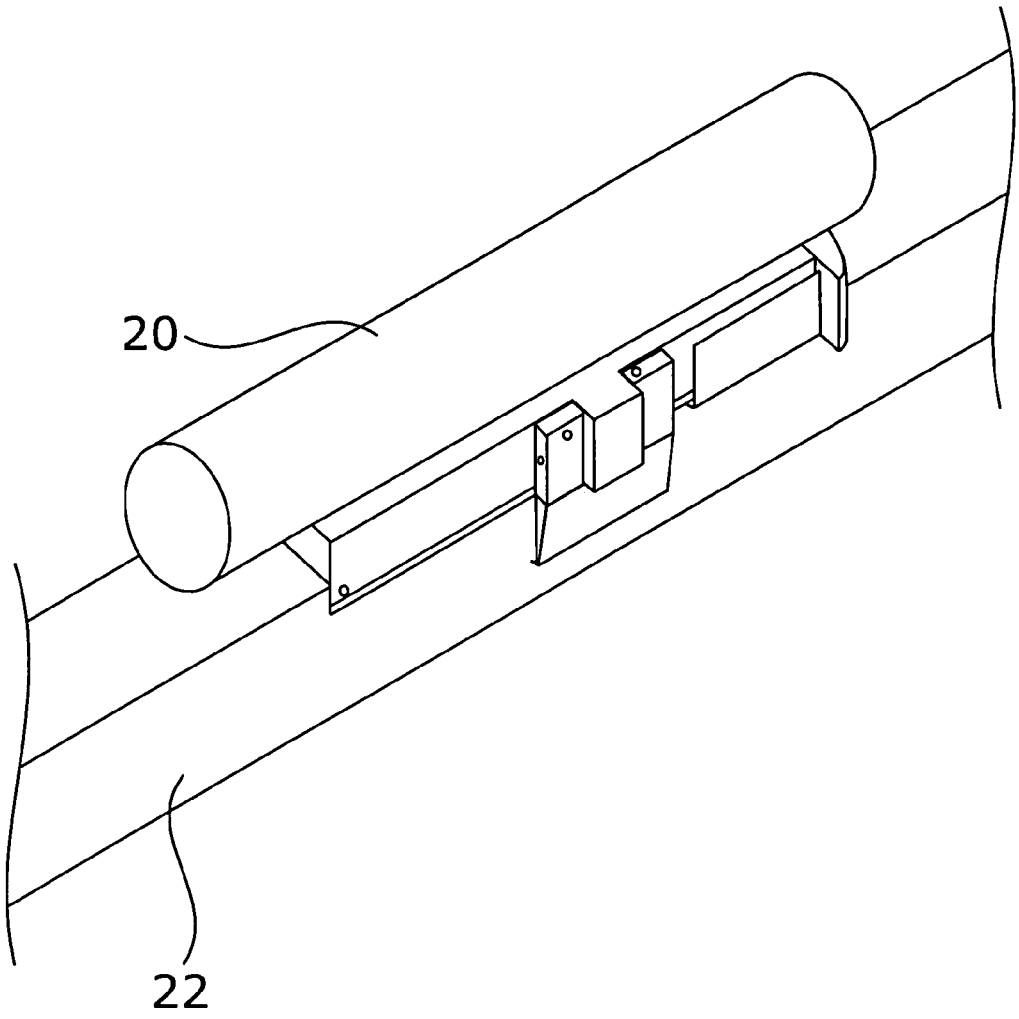
FIG. 3 depicts a perspective view of a night vision aid (shown diagrammatically) in place on the mounting apparatus of this invention.

Referring now to FIG. 3, the mounting device 10 is shown in place on the frame of a firearm 22, with a night vision aid 20 (shown diagrammatically) installed on the mounting device 10.

Figure 4:
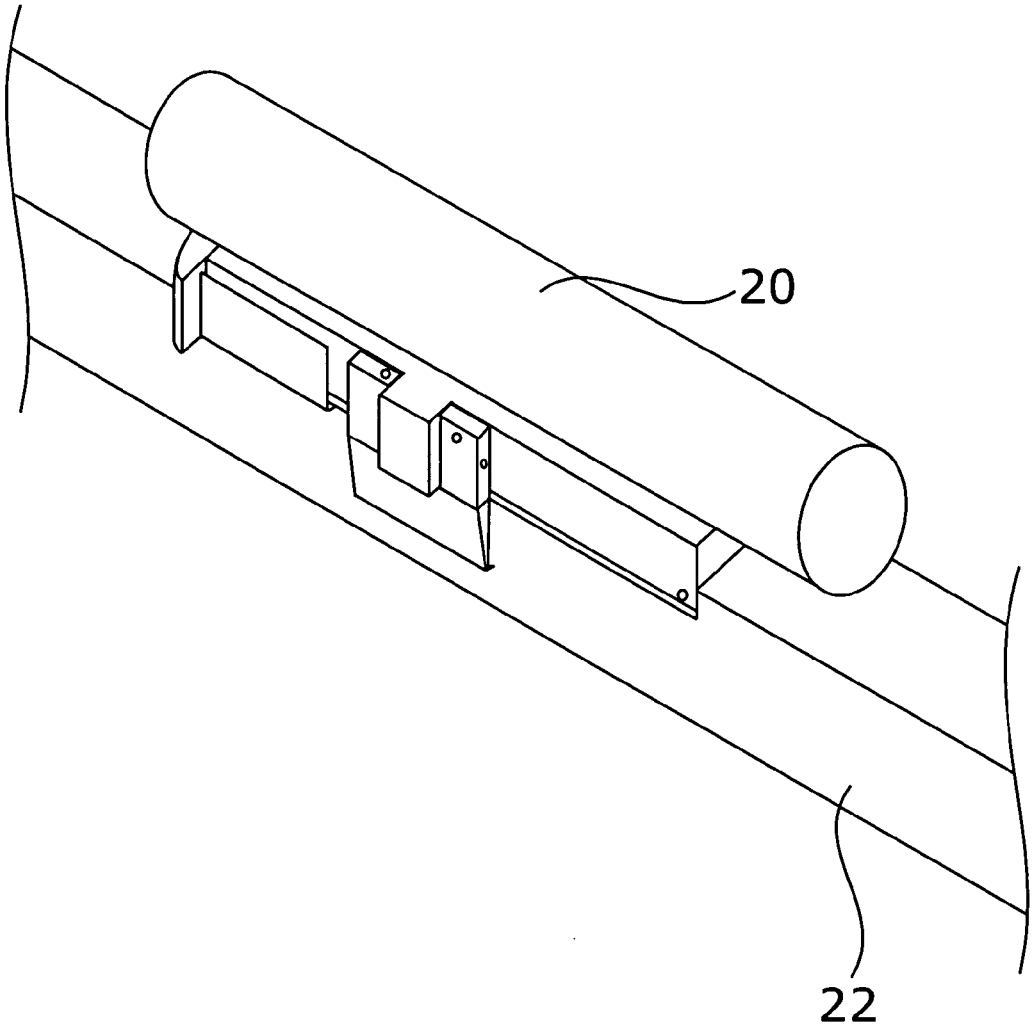
FIG. 4 depicts a perspective view of a rifle with a scope (shown diagrammatically) in place on the mounting apparatus of this invention.

Referring now to FIG. 4, a scope 26 (shown diagrammatically) is shown installed on the mounting device 10, with the mounting device 10 shown in place on the frame of a firearm 28.

Figure 5:
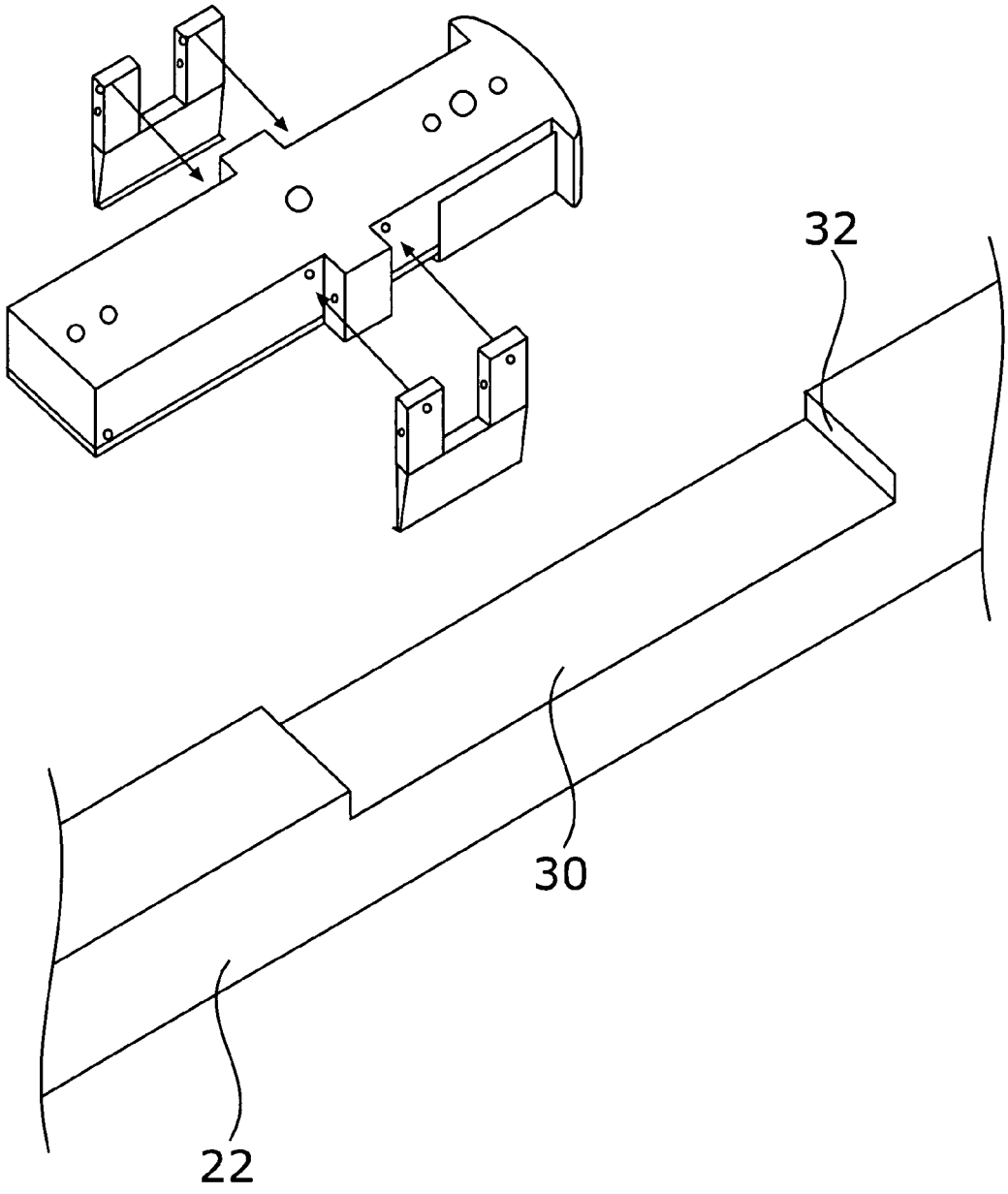
FIG. 5 depicts the frame of a firearm with the rear sight removed, illustrating the reveal of the rear sight.

Referring now to FIG. 5, a firearm frame 22 is shown with the rear sight (not shown) removed, allowing the rear sight reveal 30 and the front face of the rear sight reveal 32 to be observed.

Since other modifications and changes varied to fit particular operating requirements and environments will be apparent to those skilled in the art, the invention is not considered limited to the example chosen for purposes of disclosure and covers all changes and modifications which do not constitute departures from the true spirit and scope of this invention.

Having thus described the invention, what is desired to be protected by Letters Patent is presented in the subsequently appended claims.

What is claimed is:

1. A mounting device for securing a targeting aid, to a frame of a firearm, comprising:

at least two clamping jaws;

a base having a substantially flat lower surface for mounting on the top of the frame of a firearm that supports said clamping jaws on oppositely disposed sections thereof, and a top surface of said base for mounting said targeting aid selected from a group consisting of a scope and a night vision aid, said clamping jaws fixing the base to the frame of said firearm, said clamping jaws being pivotally disposed about said base, said base being mounted within a reveal of a rear sight of said frame of said firearm; and pivoting means supported upon said base for pivoting said clamping jaws into pivotal engagement with said frame of said firearm, whereby said base is secured thereto.

2. The mounting device in accordance with claim 1, wherein said base is mounted against a front face of said reveal of a rear sight of said firearm, for rigidly securing against the forces of recoil that tend to misalign said targeting aid.

3. The mounting device in accordance with claim 1, wherein said pivoting means comprises a plurality of screws that engage the clamping jaws with said base and adjust a clamping jaw pivotal position with respect to said base.

4. The mounting device in accordance with claim 1, wherein said clamping jaws are pivotal about the mid-portion of said base.

5. A mounting device for securing a targeting aid to a frame of a firearm, comprising:

a pair of clamping jaws;

a base that supports said pair of clamping jaws on oppositely disposed mid-sections thereof, and a top surface of said base for mounting aid targeting aid selected from a group consisting of a scope and night vision aid, said clamping jaws fixing the base to the frame of said firearm, said clamping jaws being pivotally disposed about said base, said base being mounted within a reveal of a rear sight of said frame of said firearm; and pivoting means supported upon said base for pivoting said clamping jaws into pivotal engagement with said frame of said firearm, whereby said base is secured thereto.

6. The mounting device in accordance with claim 5, wherein said base is mounted against a front face of said reveal of a rear sight of said firearm, for rigidly securing against the forces of recoil that tend to misalign said targeting aid.

7. The mounting device in accordance with claim 6, wherein said pivoting means comprises a plurality of screws that engage the clamping jaws with said base and adjust a clamping jaw pivotal position with respect to said base.

8. The mounting device in accordance with claim 6, wherein said clamping jaws are each pivotal about a mid-portion flange disposed upon said base.

* * * * *